US006435083B1

(12) United States Patent
Knödler et al.

(10) Patent No.: US 6,435,083 B1
(45) Date of Patent: Aug. 20, 2002

(54) PRESS HAVING A PLUNGER ADJUSTING SYSTEM, PARTICULARLY FOR MASSIVE FORMING

(75) Inventors: Richard Knödler, Schwäbisch Gmünd; Bernhard Lutz, Börtlingen, both of (DE)

(73) Assignee: Schuler Pressen GmbH & Co. KG, Goeppingen (DE)

( * ) Notice: Subject to any disclaimer, the term of this patent is extended or adjusted under 35 U.S.C. 154(b) by 0 days.

(21) Appl. No.: 09/461,186

(22) Filed: Dec. 15, 1999

(30) Foreign Application Priority Data

Dec. 15, 1998 (DE) ..... 198 57 744

(51) Int. Cl.[7] ..... B30B 5/00
(52) U.S. Cl. ..... 100/257; 100/291
(58) Field of Search ..... 100/48, 257, 291, 100/346; 72/441, 443, 446, 453.03; 83/530, 640

(56) References Cited

U.S. PATENT DOCUMENTS 2,465,734 A * 3/1949 Lewin ..... 100/257
2,818,798 A * 1/1958 Deykin ..... 100/257
3,771,930 A * 11/1973 Ginzel et al. ..... 100/257
3,889,515 A * 6/1975 Grombka ..... 100/257
3,948,077 A * 4/1976 Bothe ..... 72/441
5,092,151 A * 3/1992 Catti et al. ..... 72/453.03
5,345,861 A * 9/1994 Brewer et al. ..... 100/257
5,349,902 A * 9/1994 Daniel et al. ..... 100/257
5,375,513 A * 12/1994 Michael et al. ..... 100/100
5,398,601 A * 3/1995 Schockman et al. ..... 100/257
5,445,072 A * 8/1995 Yagi et al. ..... 100/257
5,493,959 A * 2/1996 Yagi et al. ..... 100/257
5,746,122 A * 5/1998 Gietz et al. ..... 100/257

* cited by examiner

*Primary Examiner*—Stephen F. Gerrity
*Assistant Examiner*—Louis Huynh
(74) *Attorney, Agent, or Firm*—Crowell & Moring LLP

(57) ABSTRACT

A press has a press plunger with an adjustable pressure piece. By way of an adjusting device, this pressure piece is supported on the remaining press plunger. A motor-operated tensioning device is additionally assigned to the motor-operated adjusting device. The adjusting device as well as the tensioning device are operated by force, that is, can be operated by corresponding drives. These are connected with a control device which coordinates the work of the adjusting device and of the tensioning device.

14 Claims, 4 Drawing Sheets

PRESS HAVING A PLUNGER ADJUSTING SYSTEM, PARTICULARLY FOR MASSIVE FORMING

BACKGROUND OF THE INVENTION

This application claims priority of DE 198 57 744.3, filed Dec. 15, 1998, the disclosure of which is expressly incorporated by reference herein.

The present invention relates to a press for massive forming.

In the case of a fairly large number of presses, the lower dead center position, in which the upper tool part and the lower tool part of the forming tool take up their maximally approached position, must be adjustable. This requires corresponding adjusting devices on the press plunger if the adjustment is not to take place at the tools. As a rule, adjustable tools require much higher expenditures than non-adjustable tools.

Particularly in the case of presses for massive forming, considerable forming forces occur on the workpieces which must be applied by the slide. An adjusting device must therefore be capable of withstanding the occurring forces, i.e., that is, it must have a correspondingly robust construction. If an adjusting device is provided on the press slide, it will be moved back and forth with the slide. Particularly at higher stroke rates, the weight of the adjusting device will therefore be noticeable. The weight should therefore be kept as low as possible.

As a rule, the adjustment of the lower dead center of a press is necessary after a tool change. Beyond that, a readjusting of the lower dead center may become necessary not only when the press is set up but occasionally, also at other points in time. This should naturally take place as easily as possible. Stoppage times should be minimized.

SUMMARY OF THE INVENTION

An object of the present invention is to provide a press, particularly for massive forming, which can be easily operated with a view to the above-mentioned requirements.

This object has been achieved by providing a press for massive forming and the like having a press plunger arranged is to be driven back and forth by a drive in a working direction and in an opposite direction and having an adjustably disposed pressure piece, an adjusting device for supporting the pressure piece on the press plunger at least in the working direction in adjustable positions, an adjusting drive operatively associated with the adjusting device for position influencing, a holding device configured to hold the pressure piece at least in the operation on the adjusting drive and a control device for controlling the adjusting drive.

The press has a press plunger with an adjustable section. The adjustable section is a pressure piece which operates directly as the tool or which carries a tool. At least when the press is operating, the pressure piece is fixedly connected with the rest of the press plunger. It is locked to the latter and, together therewith, carries out a back-and-forth working movement in the working direction and in the opposite direction.

The adjustment of the pressure piece with respect to the rest of the press plunger is carried out by an adjusting device. The adjusting device is primarily used for supporting the pressure piece in an adjustable position on the remaining press plunger.

An object of the adjusting device is, therefore, to transmit, in the adjusted relative position between the pressure piece and the rest of the press plunger, the required pressure force from the press plunger to the pressure piece.

The upward movement of the plunger is transmitted by the holding device to the pressure piece. The holding device can be a tensioning device which tensions the pressure piece against the adjusting device and holds it on the latter only when a desired pressure piece working position is set.

The function of the tensioning device is preferably only that of locking the pressure piece. When the adjusting device takes over the force transmission for the working stroke, the tensioning device only still has to transmit the withdrawal force from the press plunger to the pressure piece during the return stroke. Because the forces occurring in this case are clearly lower than the forming forces, the tensioning device may have a comparatively light construction. The mechanism used for adjusting the pressure piece is therefore divided into an adjusting device and a tensioning device.

The tensioning device can be automatically released and locked by a tensioning drive so that the adjusting device can be adjusted load-free at low expenditures of force as soon as the tensioning device is released. No manual access is required in this case to the pressure piece or its tensioning device. The pressure piece adjustment can be carried out fully automatically or at least in a remote-controlled manner by the adjusting drive and the tensioning drive. This is particularly advantageous and important in the case of presses which have a working space for the tool and the plunger which is separate from the environment. As a result, the adjusting operations can be carried out more easily and faster and with lower physical effort. Without the requirement of opening covers, protective grids or the like, the tensioning device can be released very rapidly, whereby a construction is obtained which is reasonable in cost.

In principle, the adjusting device can be implemented in different manners. It was found to be advantageous, however, to provide an intermediate piece between the slide and the plunger whose effective length can be adjusted by the adjusting drive. The intermediate piece may be, for example, a straight wedge or a worm, i.e., a spirally wound wedge, whose wedge surface extends in a circle and ascends in the axial direction. An intermediate piece which is a straight wedge is displaced transversely to the plunger for the adjustment of the plunger, for which a linear drive is preferably used. This linear drive may be formed, for example, by a hydraulic motor or an electric motor with a geared spindle drive. Other drives are contemplated as being within the scope of the present invention.

The preference of the construction of the adjusting device as a straight or curved or spiral wedge advantageously results in a self-locking arrangement if the wedge angle is sufficiently acute. For example, a displacement or rotation of the wedge because of the forming forces to be transmitted does not have to be expected if the static friction between the inclined surface of the wedge and the corresponding opposite contact surface is greater than the force component in the surface direction resulting from the force transmission and the inclination of the surface.

In addition, the movement of the wedge can be limited by a self-locking linear drive. Such a drive is obtained, for example, by the above-mentioned geared spindle drive. Also, worm gears or other self-locking gears may be arranged in the force transmission path. As required, the adjusting drive can also be braked electrically or mechanically.

The tensioning device tensions the pressure member against the adjusting device. In a particularly simple embodiment, a screw cap is used as the tensioning device and holds the plunger against the adjusting device. The screw cap is connected with a tensioning drive, such as a hydraulic motor or an electric motor. When the tensioning device is released, the adjusting device can be adjusted with a low expenditure of force. When the tensioning device is in the tensioning position, the adjusting device is locked thereby and can preferably not be adjusted. This minimizes the danger of an accidental release as the result of the adjustment of the adjusting device. In addition, the adjusting drive can be triggered by low power.

In a currently preferred embodiment, the pressure member is displaceably disposed in a receiving sleeve which is detachably connected with the press slide. The receiving sleeve can, for example, be held by tensioning claws which are to be pushed laterally onto inclined surfaces. The force transmission from the slide onto the pressure piece does not take place, however, by way of the receiving sleeve but preferably from the press slide by way of the adjusting device directly to the pressure piece. In this manner, elastic microdeformations, which may occur on the pressure piece and the slide in the proximity of the lower dead center at maximal forming force, are kept away from the receiving sleeve. The tensioning claws are prevented thereby from increasing their tension and tightening on the inclined surfaces of the receiving sleeve when the press is operating. This results in a detachability and exchangeability of the receiving sleeve together with the pressure piece which presents no problems.

In a preferred embodiment, the control device coordinates the operation of the adjusting drive and of the tensioning drive. The adjusting drive is not activated before the tensioning drive has released the tensioning device. In addition, the tensioning drive does not lock the pressure piece, i.e., tensions it against the adjusting device, before the adjusting drive is stopped.

In a comfortable embodiment, particularly during the adjustment of the pressure piece away form the press slide, (i.e., during the adjustment in the working direction), the control device can open the tensioning sufficiently wide to create the required clearance for the resetting of the adjusting device. In order to achieve this, the adjusting drive and the tensioning drive can be constructed as servo motors. The number of revolutions required for causing a desired adjustment can be precalculated and defined by the control device.

The holding device can also be operated without a tensioning device. The adjusting device, which is constructed, for example, as a wedge which can be adjusted transversely to the working direction, is then constantly connected with the press plunger and with the pressure piece. For the connecting, linear guides can be used whose moving direction coincides with the moving direction of the wedge.

BRIEF DESCRIPTION OF THE DRAWINGS

Other objects, advantages and novel features of the present invention will become apparent from the following detailed description of the invention when considered in conjunction with the accompanying drawings.

DETAILED DESCRIPTION OF THE DRAWINGS

Figure 1:
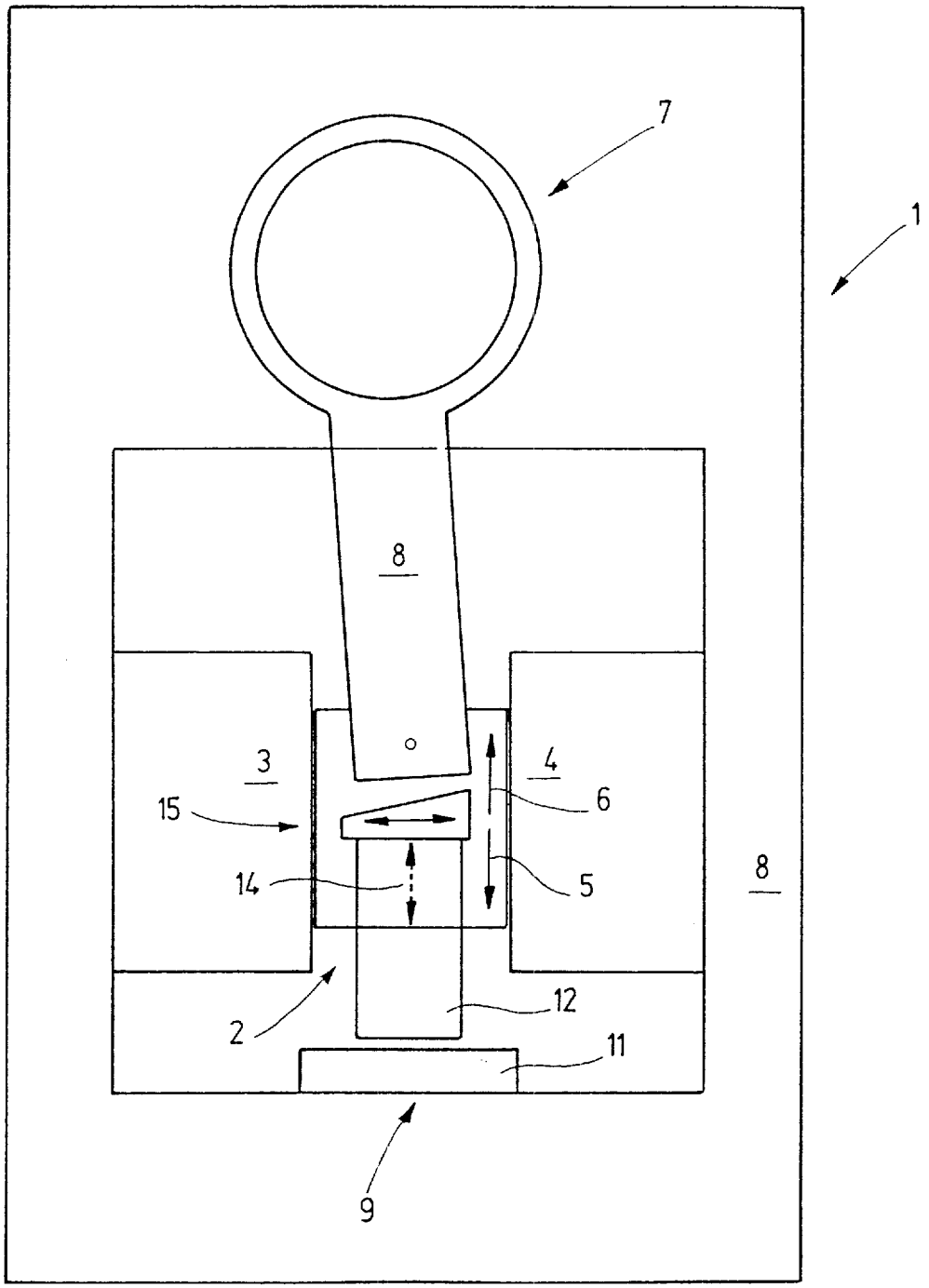
FIG. 1 is a schematic side view of a press for massive forming.

FIG. 1 illustrates a press designated generally by numeral 1 which is used for massive forming. The press 1 has a press slide 2 which is disposed in a corresponding guide 3, 4 to be displaceable in a working direction 5 and an associated opposite direction 6. An eccentric device 7 and a connecting rod 8, which is swivellably connected with the press slide 2, are used for driving the slide 2. The eccentric drive 7 moves the press slide 2 in the working direction 5 and in the opposite direction 6 toward and away from an abutment 9 carried by a press frame 8. The abutment 9 carries a bottom tool 11 to which a pressure plunger 12 pertains, which forms the top tool. This pressure plunger 12 is moved back and forth together with the press slide 2.

Figure 2:
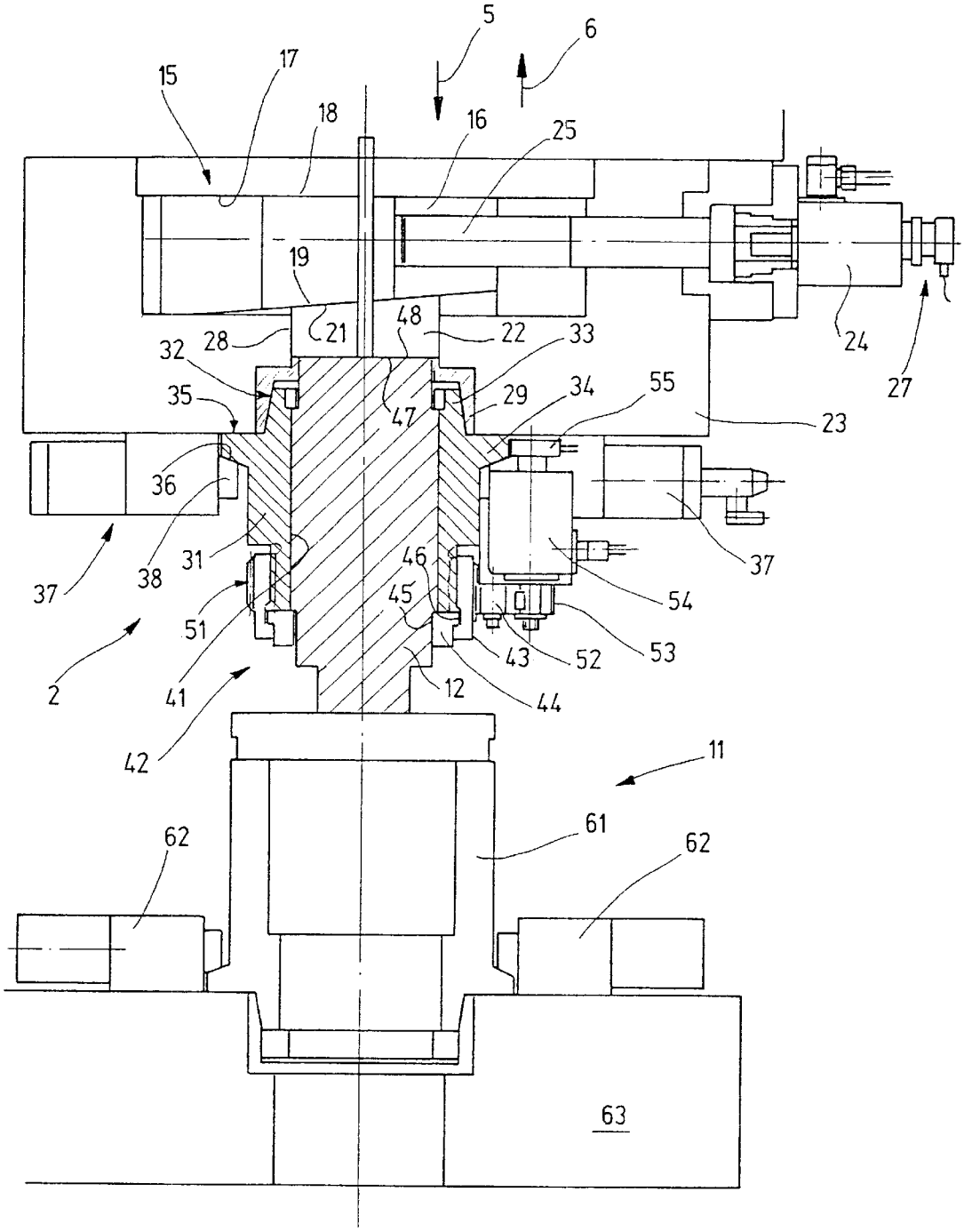
FIG. 2 is a partial cross-sectional side view of the press shown in FIG. 1.

In order to be able to adjust the dead center position of the pressure piece 12 with respect to the rest of the press slide 2, as indicated in FIG. 1 by an arrow 14, an adjusting device 15 is arranged between the press slide 2 and the pressure piece 12 as seen in FIG. 2. This adjusting device 15 includes a wedge 16 which is arranged to be movable or displaceable transversely to the pressure piece 12. The press slide has a contact surface 17 for the wedge, on which contact surface 17 the wedge 16 can be displaced transversely to the working direction 5. By way of a flat side 18, the wedge 16 rests against the contact surface 17. On the opposite side, the wedge 16 is provided with a preferably planar inclined surface 19 which encloses an acute angle with the planar surface 18. An intermediate piece 22 provided with an inclined surface 21 of the same inclination rests against the inclined surface 19. The intermediate piece 22 is disposed in a frame-type top part 23 to be displaceable in the working direction 5 and the opposite direction 6. The top 23 is part of the press slide 2 and can be moved together therewith.

A threaded spindle 25, which by way of an end provided with a thread is disposed in a threaded bore of the wedge 16, is used for the displacement of the wedge 16. The threaded spindle 25 is rotatably but axially non-displaceably in the top part 23. At its end pointing away from the wedge 16, the threaded spindle 25 is connected with a rotary drive, such as an electric servo motor 24, which is carried by the top part 23. The electric motor 24 is, for example, a geared motor and can be connected with a position sensor, such as an incremental angle transmitter 27 or another path sensor.

Coaxially to the intermediate piece 22, which is axially displaceably disposed in a corresponding opening 28 of the top part 23, a conical sleeve 29 may be arranged on the carrier frame 23. The conical sleeve 29 is used for receiving and bearing a receiving sleeve 31. The conical sleeve 29 has a conical opening 32 in which a tube-shaped extension 33 of the receiving sleeve 31 is disposed. The extension 33 tapers conically toward the end.

Following the conical extension 33, the receiving sleeve 31 is provided with a ring flange 34 which has a ring-shaped contact surface 35 so that it rests on the bottom side of the guide frame 23. On the opposite side, the ring flange is provided with a ring-shaped inclined surface 36 which is used as a clamping or tensioning surface.

Two or several hydraulic tension jacks 37 are associated with the clamping or tensioning surface 36. The tension jacks 37 press upon the clamping surface 36 by way of one locking bar 38 respectively which is disposed to be displaceable transversely to the pressure piece 12 or its longitudinal direction. When the locking bars 38 are advanced radially toward the interior, the ring flange 34 is pressed against the guide frame 23. When the locking bars 38 are pulled back, the receiving sleeve 31 is released.

The receiving sleeve 31 is provided with an axially continuous opening 41 in which the pressure piece 12 is disposed which projects on the end side out of the receiving sleeve 31. The pressure piece 12 is tensioned by a tensioning device 42 against the adjusting device 15. The tensioning device includes a screw cap or tightening nut 43 which is connected with the pressure piece 12 by way of an intermediate ring 44, a so-called bayonet. For (this purpose, it has a ring shoulder 45 which points away from the adjusting device 15 and into which the intermediate ring 44 engages. The tightening nut 43, in turn, reaches over an outward-pointing ring flange 46 of the intermediate ring 44. On its other side, the tightening nut 43 has an internal thread which engages in an external thread provided on the receiving sleeve 31. When the tightening nut 43 is tightened, the pressure piece 12 with its upper face 47 is caused to press against a plane surface of the intermediate piece 22 which extends transversely to the working direction, and therefore against the wedge 16 which is, in turn, supported on the plane surface 18.

For tightening and releasing the tightening nut 43, the outer circumference of the tightening nut 43 is provided with a toothing 51. On the exterior side of the receiving sleeve 31, a bearing block is provided which carries a pinion in a rotatably disposed manner which meshes with the toothing 51. The pinion 52 also meshes with a gear wheel (output) 53 of an electric motor (geared motor) 54. The electric motor 54 forms a tensioning drive for the tightening and releasing the tightening nut 43. It is connected with a position sensor, such as an incremental angle transmitter 55.

While the pressure piece 12 forms a top tool, a bottom tool 61 is assigned to the latter in an opposed manner and forms a bottom die. Similar to the receiving sleeve 31, the bottom tool 61 is held by hydraulic tensioning devices 62 on a bottom part 63 forming the abutment 9.

Figure 3:
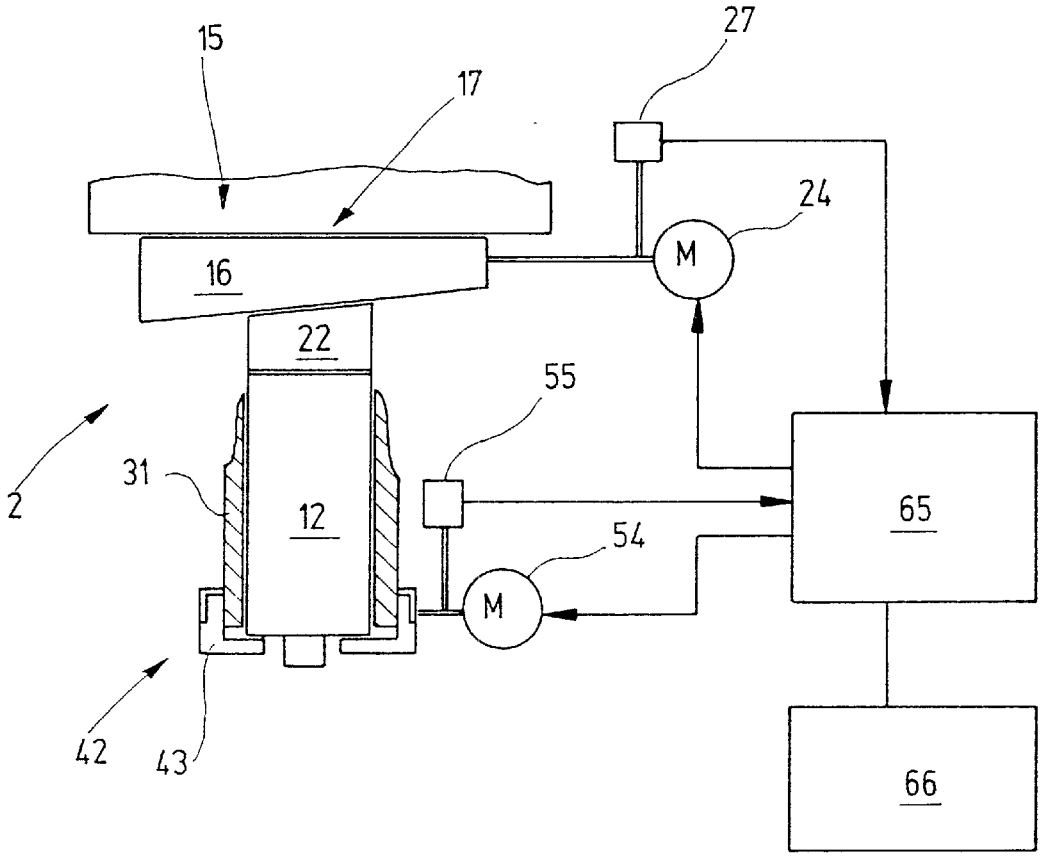
FIG. 3 is a schematic view of the press slide of the press shown in FIGS. 1 and 2, with a schematic view of the adjusting device and of the tensioning device in conjunction with its control.

As illustrated in the basic diagram of FIG. 3, the electric motors 24, 54 are controlled by a control device 65 which, in addition, is connected with the incremental angle transmitters 27, 55. Also, the control device 65 is connected with an input unit 66 by way of which the desired adjusting operation to be carried out by the electric motors 24, 54 can be reported to the control device 65.

The lower dead center position of the pressure piece 12 is adjusted as follows. First, it must be assumed that the press 1 is operating and it is determined that the lower dead center position is to be adjusted. In this situation, the press slide 2 is stopped. By way of the input unit 66 or other interface, the adjusting data are now fed to the control device 65. That is, the control device 65 receives a report as to how far and in which direction the pressure piece 12 is to be adjusted.

In the former case, the pressure piece 12 is to be adjusted farther toward the bottom tool 61. For this purpose, the control device 65 first triggers the electric motor 54 which rotates the tightening nut 43 into the releasing position to release the pressure piece 12 which had previously been pressed by way of the intermediate piece 22 onto the wedge 16. The tightening nut 43 is now rotated beyond the new adjusting position. That is, it is screwed farther away from the wedge 16 than the pressure piece 12 is to be adjusted. The positioning is monitored by the incremental angle transmitter 55 by the control device 65.

When the tightening nut has reached its desired position, the motor 54 is stopped. Then the control device 65 controls the motor 24 such that the wedge 16 in FIG. 3 is displaced toward the right until it takes up the new position determining the desired pressure piece position. This is monitored by the control device 65 by way of the incremental angle transmitter 27. When the desired position has been reached, the electric motor 24 is stopped and the electric motor 54 is now controlled again into the opposite direction. Thereby, the tightening nut 43 is rotated into the tightening direction and thus tensions the pressure piece 12 and the intermediate piece 22 against the wedge 16. After the stoppage of the motor 54, the press will be operative again. The tightening nut 43 and the wedge gearing formed by the wedge 16 or the threaded spindle 25 are self-locking so that no further locking is required. The press can now be started again, in which case the pressure piece 12 operates while going back and forth with the rest of the press slide 2.

The adjustment of the pressure piece 12 in the opposite direction takes place in a reverse manner. First, the control device 65 releases the tensioning device by controlling the electric motor 54 in the release direction, i.e., that it unscrews the tightening nut 43. The wedge 16 has now been released. The control device 65 stops the electric motor 54 and, by way of the electric motor 24, displaces the wedge 16 in FIG. 3 toward the left into the desired adjusting position. As soon as this position has been reached, which the control device 65 determines by way of the incremental angle transmitter 27, the electric motor 24 is stopped and the electric motor 54 is triggered. Thereby, the tightening nut 43 lifts and presses the pressure piece 12 against the wedge 16. The tightening of the nut 43 can be determined, for example, by the current consumption of the electric motor 54, whereupon this electric motor is switched off.

As an alternative, the electric motor 24 can also already be triggered after release of the tightening nut 43 by the triggering of the electric motor 54, while the electric motor 54 is still running. Care must be taken in each case, however, that the tightening nut 43 is not tightened before the wedge 16 has reached its desired position.

Figure 4:
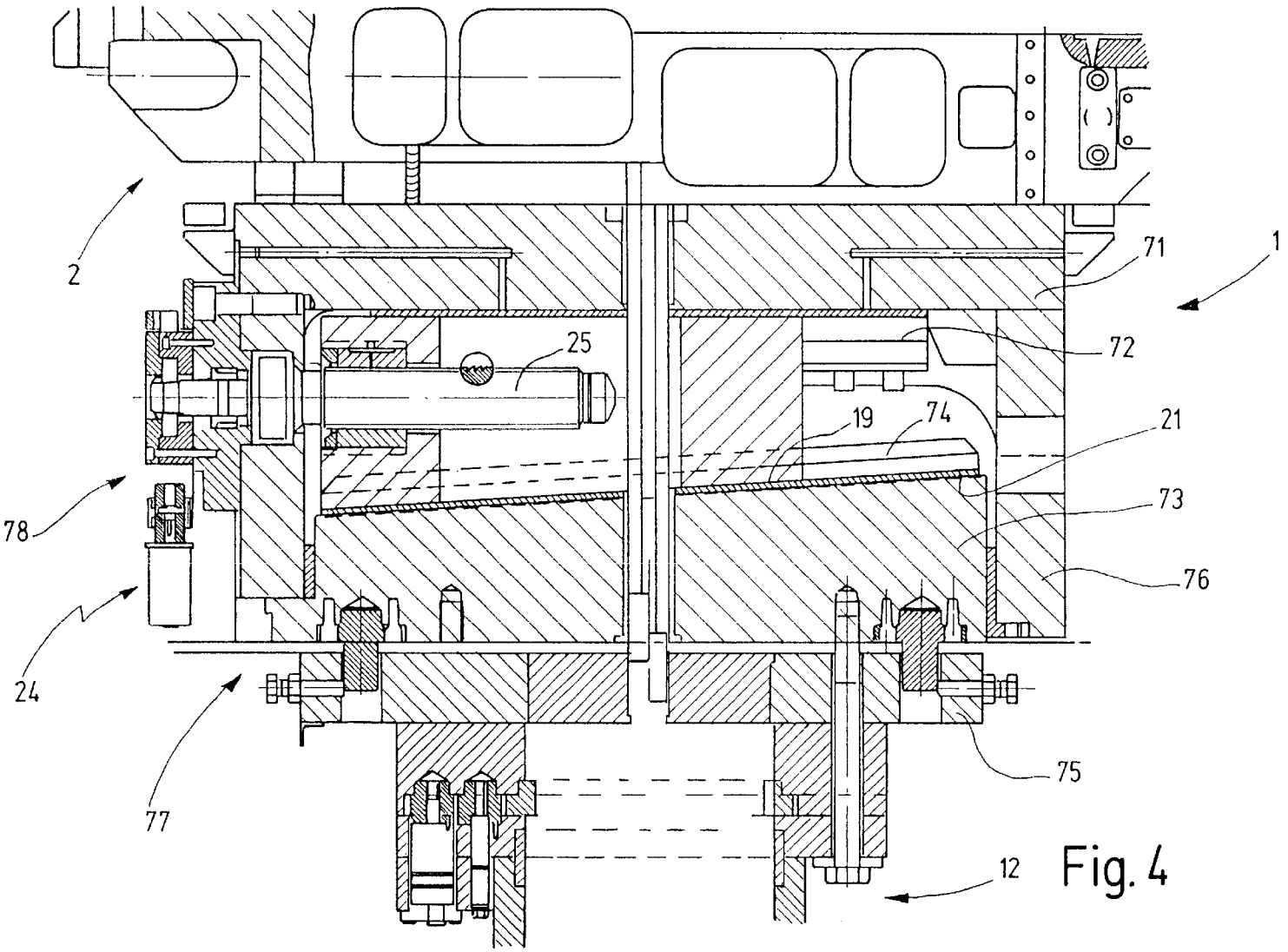
FIG. 4 is a partial cross-sectional side view of a modified embodiment of the press.

FIG. 4 shows a modified embodiment of the press 1. To the extent that this embodiment is in agreement with the above-described embodiment (i.e. has identical parts), the same reference numbers are used and reference is made to the above description. The press slide 2 carries a pressure plate 71 with a linear guide which extends transversely to the working direction of the press slide 2 which is vertical in FIG. 4. On the linear guide 72, the wedge 16 is displaceable in a direction which coincides with the ascending direction.

The linear guide 72 is set up for holding the wedge 16 on the pressure plate 71 also when vertically downward-directed forces act upon the wedge 16 in FIG. 4. The inclined surface 19 rests the wedge 16 against an inclined surface 21 of a pressure piece carrier 73. The pressure piece carrier 73 is provided on its inclined surface with a linear guide 74 which can also be tensioned against the pressing direction. The guiding direction coincides with that of the linear guide 72. The pressure piece carrier 73 is optionally connected by way of an intermediate plate 75, with the pressure piece 12.

The pressure plate 71 carries a frame 76 which surrounds the wedge 16 and forms a protection 77 against torsion for the pressure piece carrier 73. In addition, the frame carries the driving and adjusting device which is formed by the servo motor 24 and the threaded spindle 25. A gearing 78, which is carried by the frame 76 and is arranged between the threaded spindle 25 and the servo motor, results in a reduction of the rotational motor speed.

A press 1 has a press plunger with an adjustable pressure piece 12 which is supported by way of an adjusting device 15 on the remainder of the press plunger. In addition, a motor-driven tensioning device 42 is assigned to the motor-driven adjusting device 15. The adjusting device 15 as well as the tensioning device 42 are operated by force, i.e. they can be operated by corresponding drives. These drives are connected with a control device 65 which coordinates the work of the adjusting device 15 and of the tensioning device 42.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Press for massive forming comprising a press slide arranged to be driven back and forth by a drive in a working direction and in an opposite direction and having an adjustably disposed pressure piece, a wedge-configured adjusting device for supporting the pressure piece on the press slide at least in the working direction in adjustable positions, an adjusting drive operatively associated with the adjusting device for positioning the adjusting device, a holding device configured to lock the pressure piece against the adjusting device during press operation without relative movement therebetween in a direction transverse to the working direction, and a control device operatively connected to the adjusting drive for controlling the adjusting drive and to the holding device for locking the pressure piece against the wedge-configured adjusting device.

2. The press according to claim 1, wherein the adjusting device has a pressure transmission member with an effective length adjustable by the adjusting drive.

3. The press according to claim 2, wherein the pressure transmission member has a first contact surface and a second contact surface arranged at an acute angle with respect to the first contact surface, the first contact surface being aligned at substantially a right angle to the working direction.

4. The press according to claim 2, wherein the pressure transmission member is a linearly displaceable straight wedge, and the adjusting drive is a linear drive.

5. The press according to claim 4, wherein the linear drive has a force-operated rotary driving device configured to drive the wedge by way of gearing to generate a linear movement.

6. The press according to claim 1, wherein the pressure piece is displaceably disposed in a receiving sleeve on the press slide.

7. The press according to claim 6, wherein a tightening nut is configured to be screwed together with the receiving sleeve.

8. The press according to claim 1, wherein the adjusting device is a wedge arranged between the press plunger and the pressure piece so as to be adjustable transversely to the working direction of the press slide, and the holding device is formed by a first linear guide to hold the wedge on the press slide, and by a second linear guide to hold the pressure piece on the wedge.

9. Press for massive forming comprising a press slide arranged to be driven back and forth by a drive in a working direction and in an opposite direction and having an adjustably disposed pressure piece, a wedge-configured adjusting device for supporting the pressure piece on the press slide at least in the working direction in adjustable positions, an adjusting drive operatively associated with the adjusting device for positioning the adjusting device, a holding device configured to hold the pressure piece, and a control device for controlling the adjusting drive, wherein the holding device is a tensioning device having a tensioning position in which the pressure piece is locked and at least one release position in which the pressure piece is not locked, the tensioning device being arranged to interact with a tensioning drive operative to change the tensioning device into the tensioning position and into the releasing position, and the control device being configured for controlling the tensioning drive to be coordinated with the adjusting drive.

10. The press according to claim 9, wherein the tensioning device has a force generating device for tensioning the pressure piece in the tensioning position against the adjusting device and which, in the release position, does not tension the pressure piece against the adjusting device.

11. The press according to claim 10, wherein the tensioning device includes a tightening nut arranged coaxially to the pressure piece, and the tensioning drive includes a rotary drive for the tightening nut.

12. The press according to claim 9, wherein at least one of the tensioning drive and the adjusting drive comprise one of an electric drive and a hydraulic drive.

13. The press according to claim 9, wherein before triggering of the adjusting drive, the control device is configured to activate and again stop the tensioning drive to change the tensioning device into the release position, and the control device is configured to change the tensioning device into the tensioning position after the adjusting drive has reached a desired position and is stopped.

14. The press according to claim 9, wherein before triggering of the adjusting drive, the control device is configured to control the tensioning drive so that the tensioning device is released, after which the adjusting drive is triggered, and the control device is configured to monitor such that the tensioning device does not fall below a minimal play between the pressure piece and the adjusting device, and in that the control device is operatively arranged to change the tensioning drive into the tensioning position after the adjusting drive has reached a desired position and is stopped.

* * * * *